US010707555B2

(12) United States Patent
Rogers et al.

(10) Patent No.: US 10,707,555 B2
(45) Date of Patent: Jul. 7, 2020

(54) ELECTRONICALLY STEERABLE CONFORMAL ANTENNA

(71) Applicant: The Boeing Company, Chicago, IL (US)

(72) Inventors: John E. Rogers, Owens Cross Roads, AL (US); John D. Williams, Decatur, AL (US)

(73) Assignee: THE BOEING COMPANY, Chicago, IL (US)

( * ) Notice: Subject to any disclaimer, the term of this patent is extended or adjusted under 35 U.S.C. 154(b) by 17 days.

(21) Appl. No.: 16/143,211

(22) Filed: Sep. 26, 2018

(65) Prior Publication Data

US 2020/0099123 A1 Mar. 26, 2020

(51) Int. Cl.
*H01Q 13/10* (2006.01)
*H01Q 1/22* (2006.01)

(52) U.S. Cl.
CPC ..... *H01Q 1/2283* (2013.01); *H01Q 13/10* (2013.01)

(58) Field of Classification Search
CPC ..... H01Q 1/2283; H01Q 13/10
See application file for complete search history.

(56) References Cited

PUBLICATIONS

Al-Charchafchi, S., et al., "Electronically Tunable Microstrip Patch Antennas", IEEE Antennas and Propagation Society International Symposium, Jun. 1998, pp. 304-307.
Varadan, V.K., et al., "Design and development of electronically tunable microstrip antennas", Smart Materials and Structures, 1999, pp. 238-242, vol. 8.
Yang, S-L, S., et al., Frequency Reconfigurable U-Slot Microstrip Patch Antenna, IEEE Antennas and Wireless Propagation Letters, 2008, pp. 127-129, vol. 7.
Sheta, A-F., et al., "A Widely Tunable Compact Patch Antenna", IEEE Antennas and Wireless Propagation Letters, 2008, pp. 40-42, vol. 7.
Liu, L., et al., "Liquid crystal tunable microstrip patch antenna", Electronics Letters, Sep. 25, 2018, pp. 1-2, vol. 44 No. 20.
Karabey, O.H., et al., "A 2-D Electronically Steered Phased-Array Antenna With 2×2 Elements in LC Display Technology", IEEE Transactions on Microwave Theory and Techniques, May 2012, pp. 1297-1306, vol. 60, No. 5.

*Primary Examiner* — Graham P Smith
(74) *Attorney, Agent, or Firm* — Gates & Cooper LLP

(57) ABSTRACT

An electronically steerable conformal antenna is disclosed. The antenna comprises a circuit board having a composite dielectric. The composite dielectric includes an array of a plurality of antenna elements disposed on the top surface and an array of tunable cavities, each tunable cavity disposed between an associated antenna element and a conductive ground plane on the composite dielectric's bottom surface. The composite dielectric also includes a conductor, extending from an antenna input through the composite dielectric and the tunable cavities and which forms a microstrip between each of the antenna elements.

22 Claims, 10 Drawing Sheets

SIDE VIEW

SIDE VIEW

ELECTRONICALLY STEERABLE CONFORMAL ANTENNA

BACKGROUND

1. Field

The present disclosure relates to systems for receiving and transmitting signals, and in particular to an electronically steerable conformal antenna and a method for producing same.

2. Description of the Related Art

There is a need for sensors capable of conforming to non-planar surfaces such as aircraft wings and fuselages. Such sensors, known as conformal sensors, substantially conform to the contours of the surface that they are mounted on or of which surface they form a part. Low profile conformal sensor nodes are useful in many applications, including structural health monitoring and diagnostic testing. With regard to structural health monitoring, conformal antennas in sensor nodes can gather information about an aircraft in real time, including airframe characteristics including hoop stress, shear stress, compression, corrosion resistance, bending, torsion, crack growth, high local loads, longitudinal stress and impacts. With regard to diagnostic testing, conformal antennas in sensor nodes can be used for condition monitoring on the factory floor.

Unmanned aerial vehicles (UAVs) have conformal surfaces with low radii of curvature, and typically need light weight antennas with low radar cross sections and low air drag for improved efficiency. Also, like other aircraft, UAV surfaces are typically either metallic or a carbon fiber material, which are conductive in nature and may change the behavior of an antenna. In some applications, there is a need for conformable electronically steerable antennas for their ability to "point" or direct their energy in a particular direction.

Existing steerable antennas based on electronics have magnitude and/or phase shifting ability for each antenna element; however, they often have high power consumption and are cost prohibitive for applications desiring a low-cost, low-power solution. Alternatively, varactors or diodes can be used for steering; however, they can be difficult to integrate into processing.

What is needed is a low profile electronically steerable conformal antenna.

SUMMARY

To address the requirements described above, this document discloses an electronically steerable conformal antenna, comprising a circuit board having a composite dielectric. The composite dielectric comprises a bottom surface and a top surface. The bottom surface has an electrically conductive ground plane and the top surface has an array of a plurality of antenna elements. The composite dielectric also comprises an array of tunable cavities, each tunable cavity disposed between an associated antenna element of the plurality of antenna elements and the bottom surface conductive ground plane, and a conductor, extending from an antenna input through the composite dielectric and the tunable cavities. The conductor forms a microstrip feed network extending between each of the antenna elements.

In one embodiment, each tunable cavity comprises a tunable material with a permittivity that is tunable via application of a DC bias voltage. In another embodiment, each of the plurality of antenna elements comprises a conductive surface having a slot; and at least a portion of the conductor is disposed within each of the tunable cavities between the slot and the bottom surface conductive ground plane. In still another embodiment, the antenna where: the antenna elements are formed by a first conductive material on a top surface of a first layer of the composite dielectric; the conductor is formed by a second conductive material on a top surface of a third layer of the composite dielectric; and the bottom surface conductive ground plane is formed by a third conductive material on a bottom surface of a fourth layer of the composite dielectric.

Another embodiment is evidenced by a method of forming a steerable conformal antenna. The method comprises disposing a conductive antenna element on a top surface of a first dielectric layer, processing the first dielectric layer to create at least one port therethrough, processing a second dielectric layer to create a first void and a channel therethrough, disposing a conductor on a top surface of a third dielectric layer, processing the third dielectric layer to create a second void below the conductor, disposing a conductive ground plane on a bottom surface of a fourth dielectric layer, laminating the first dielectric layer, the second dielectric layer, the third dielectric layer, and the fourth dielectric layer, where upon lamination, where the first void is disposed between the conductive antenna element and the ground plane; and the first void and the second void together form a cavity disposed between the conductive antenna element and the conductive ground plane having the conductor disposed therethrough and the port and channel are in fluid communication with the cavity. The method also includes filling the cavity with a tunable permittivity material via the port and the channel.

Still another embodiment is evidenced by a steerable conformal antenna, formed by performing steps comprising the steps of disposing a conductive antenna element on a top surface of a first dielectric layer, processing the first dielectric layer to create at least one port therethrough, processing a second dielectric layer to create a first void and a channel therethrough, disposing a conductor on a top surface of a third dielectric layer, processing the third dielectric layer to create a second void below the conductor, disposing a conductive ground plane on a bottom surface of a fourth dielectric layer, laminating the first dielectric layer, the second dielectric layer, the third dielectric layer, and the fourth dielectric layer, where upon lamination, where the first void is disposed between the conductive antenna element and the ground plane; and the first void and the second void together form a cavity disposed between the conductive antenna element and the conductive ground plane having the conductor disposed therethrough and the port and channel are in fluid communication with the cavity, and filling the cavity with a tunable permittivity material via the port and the channel.

The features, functions, and advantages that have been discussed can be achieved independently in various embodiments of the present invention or may be combined in yet other embodiments, further details of which can be seen with reference to the following description and drawings.

BRIEF DESCRIPTION OF THE DRAWINGS

Referring now to the drawings in which like reference numbers represent corresponding parts throughout.

DESCRIPTION

In the following description, reference is made to the accompanying drawings which form a part hereof, and which is shown, by way of illustration, several embodiments. It is understood that other embodiments may be utilized, and structural changes may be made without departing from the scope of the present disclosure.

Overview

In this disclosure, an electronically steerable antenna with a low profile is presented. Each antenna element is individually tuned by applying a DC bias voltage to a tunable permittivity material such as a liquid crystal. The antenna elements have inclusive slots and are aperture coupled to a microstrip line residing above an electrically conductive ground plane. The tunable permittivity material is placed between each antenna element and the lower ground plane. A change in the permittivity results in a shift in the resonant frequency of each antenna element. The steerable antenna also has a microstrip feed network with a lower ground plane to minimize any change in the antenna's electrical behavior due to conductive surfaces. This renders the antenna surface agnostic.

The antenna comprises a number of features which can be characterized by a number of embodiments. Such features may also be combined in selected embodiments as disclosed further herein. One feature is that the antenna has tunable permittivity material placed between each antenna element and the lower ground plane such as to control the resonant frequency of each antenna element. Another feature is that the antenna has an embedded RF microstrip feed network with a lower ground plane for minimizing any change in the antenna's electrical behavior due to conductive surfaces as well as simplifying planar arraying. Still another feature is that the antenna uses an aperture coupled feed for simplistic feeding, planar arraying, and reduction of antenna failure due to flexure. Yet another feature is that the antenna can utilize thin RF dielectrics for conformal applications due to the use of an aperture coupled feed. Finally, the antenna is circularly polarized with increased bandwidth by using aperture coupled antenna elements with inclusive slots.

Figure 1A:
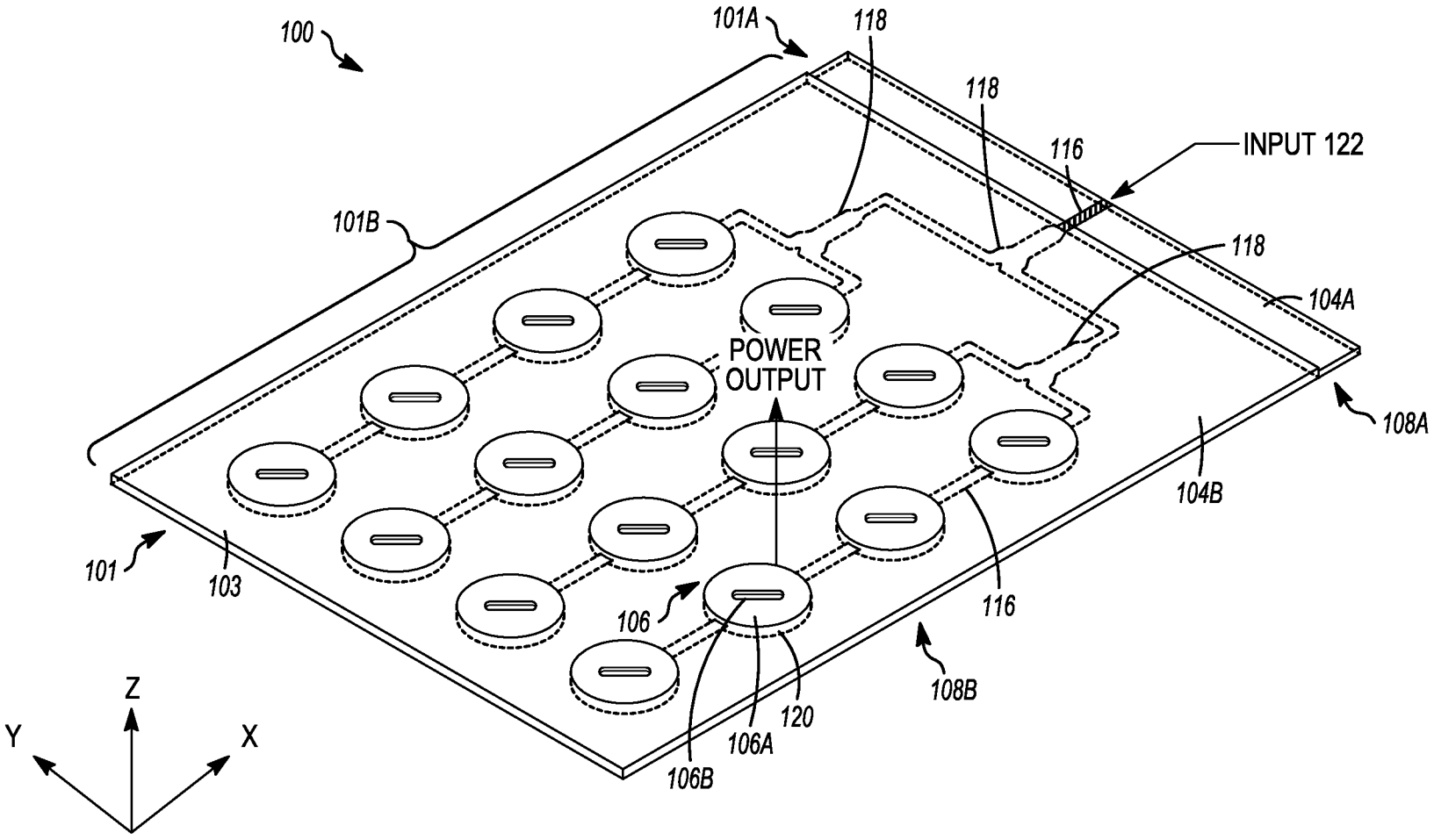
FIGS. 1A-1C are diagrams illustrating one embodiment of the electronically steerable conformal antenna.
Figure 1B:
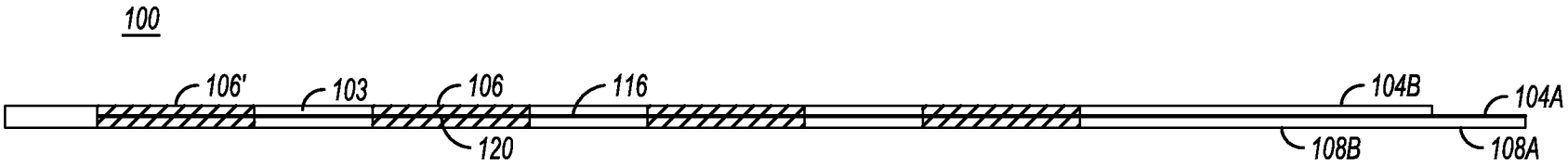
Figure 1C:
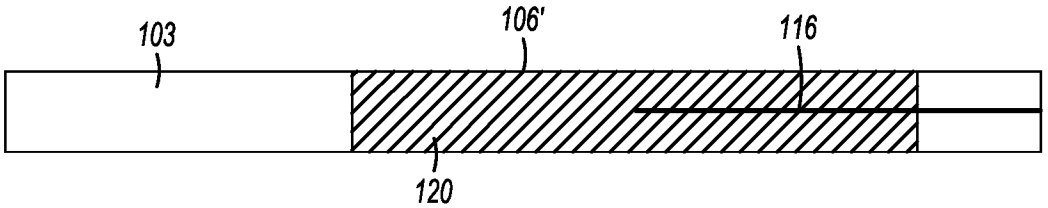

FIGS. 1A-1C are diagrams illustrating one embodiment of the electronically steerable conformal (e.g. conforming to the surface to which it is applied) antenna 100 (hereinafter alternatively referred to simply as antenna 100). In the illustrated embodiment, antenna 100 includes an RF circuit board 101 having a composite dielectric 103. The RF circuit board 101 includes a circuit board first portion 101A and a circuit board second portion 101B. The RF circuit board 101 also comprises a top planar surface 104 that has a first top surface planar portion 104A and a second top surface planar portion 104B. The second top surface planar portion 104B has at least one antenna element 106. In the illustrated embodiment, a 4×4 array of antenna elements 106 is included.

The RF circuit board 101 also comprises a bottom planar surface 108 which has a first bottom surface planar portion 108A and a second bottom surface planar portion 108B. A bottom surface ground plane 107 extends along the first bottom surface planar portion 108A and the second bottom surface planar portion 108B. A conductor 116 extending on a top surface of the circuit board first portion 101A and through the circuit board second portion 101B forming a microstrip feed network with the bottom surface ground plane 107 of the first and second bottom surface planar portions 108A and 108B, respectively. In the illustrated embodiment, the conductor 116 includes one or more power dividers 118 disposed between the antenna input 122 and the antenna elements 106. The power dividers 118 divide (or split) the antenna input into equivalent signals of reduced power that are then fed to antenna elements 106.

Each antenna element 106 comprises a conductive antenna element component 106A having a conductive surface with a slot or aperture 106B. This aperture 106B electrically couples the antenna element 106 to the microstrip feed network formed by conductor 116, the ground plane 107, and dielectric material therebetween.

The antenna 100 also comprises a tunable cavity 120 disposed between the associated antenna element 106 and ground plane 107, with the conductor 116 extending at least partially through the cavity 120 to a centroid of the cavity 120. In the illustrated embodiment, the antenna element 106 and tunable cavity 120 are of the same (or substantially similar) dimensions and are both of circular cross sections in the XY plane shown in FIG. 1A. However, the antenna 100 may be implemented in other embodiments in which the antenna element 106 and/or tunable cavity 120 are of different dimensions or cross sections.

In one embodiment, each tunable cavity 120 comprises a tunable permittivity material. In a particular embodiment, the tunable permittivity material comprises a liquid crystal having a permittivity that can be tuned by application of a DC bias voltage. In one embodiment, the permittivity of each tunable cavity 120 is individually tuned via a DC bias voltage applied between each antenna element 106 and the ground plane 107. For example, liquid crystal material is available from MERCK in which the relative permittivity (ratio of the absolute permittivity to the permittivity of a vacuum) can be changed from 2.3 to 2.8 by application of 10 volts.

In the illustrated embodiment, the antenna 100 comprises a 4×4 array of antenna elements 106. The 4×4 array has aperture coupled antenna elements 106 with inclusive slots 106B, an embedded microstrip feed formed by conductor 116 with power dividers 118, a lower ground plane 107, and tunable cavities 120 between each antenna element 106 and the lower ground plane 107.

As is discussed further below, the antenna 100 includes three conductive layers separated by four dielectric layers. The dimensions of the antenna elements 106 (i.e., diameter of conductive antenna element component 106A, slot 106B length, slot 106B width) and the dimensions (i.e., diameter) of the tunable cavities 120 are determined to maximize radiated power at the desired operating frequency.

Figure 2A:
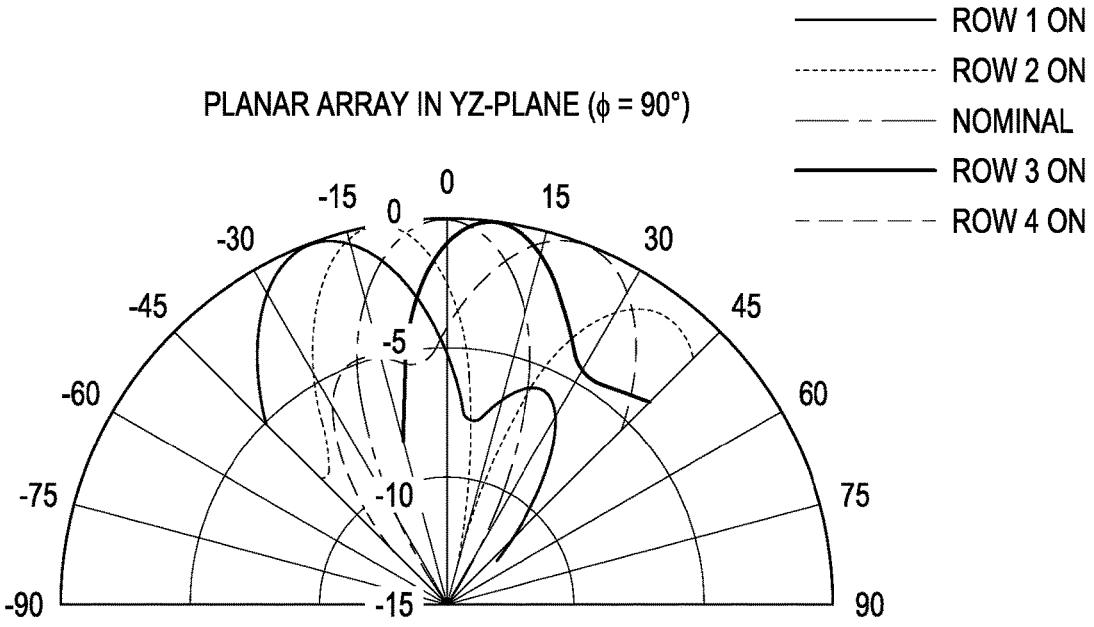
FIGS. 2A and 2B are diagrams depicting plots of the predicted performance of a 4×4 electronically steerable conformal antenna designed to operate near 10 GHz.
Figure 2B:
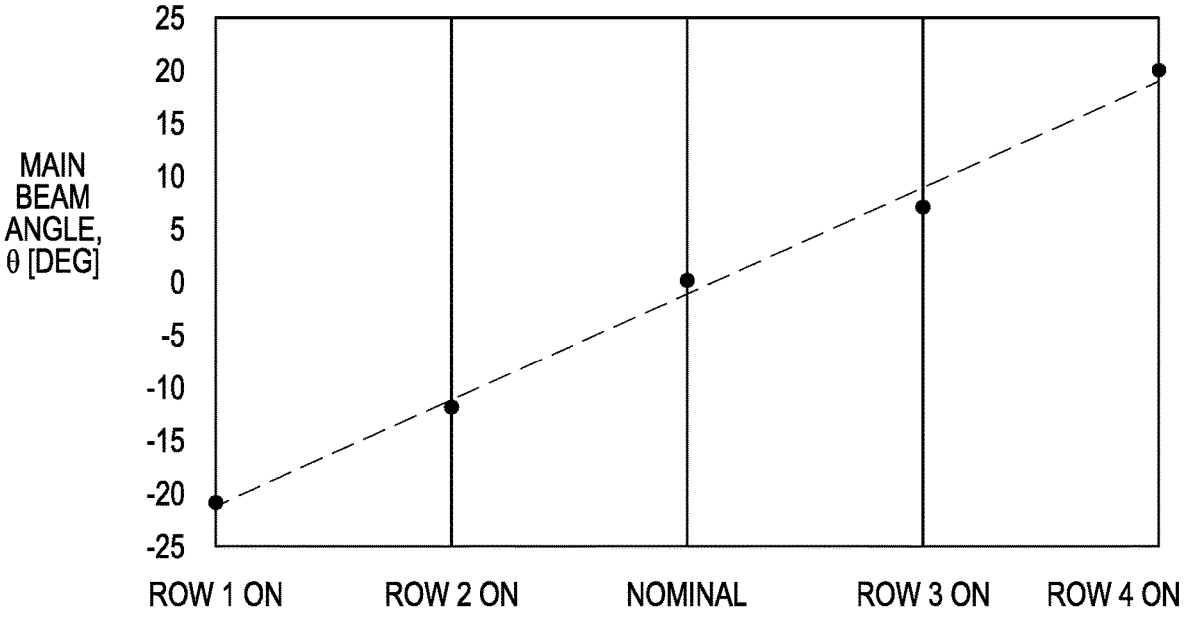

FIGS. 2A and 2B are diagrams depicting plots of the predicted performance of a 4×4 electronically steerable conformal antenna designed to operate near 10 GHz. The surface dimensions of the 4×4 array are 80 mm×55 mm and the board has four 10 Mil PYRALUX layers. FIG. 2A is a diagram illustrating the radiation pattern of the 4×4 array in the Y-Z plane (a nominal configuration, with a first row of antenna elements 106 "on", with a second row of antenna elements 106 "on", with a third row of antenna elements 106 "on", and with a fourth row of antenna elements 106 "on" (e.g. the appropriate bias voltage is applied such that the dielectric constant is changed to a desired value). The results (generated with a finite element model (FEM) solver) show a steerability of about 41 degrees. FIG. 2B is a diagram illustrating the angle of the main beam of the radiation pattern, illustrating how activation of different rows allows the main beam to be steered.

Figure 3:
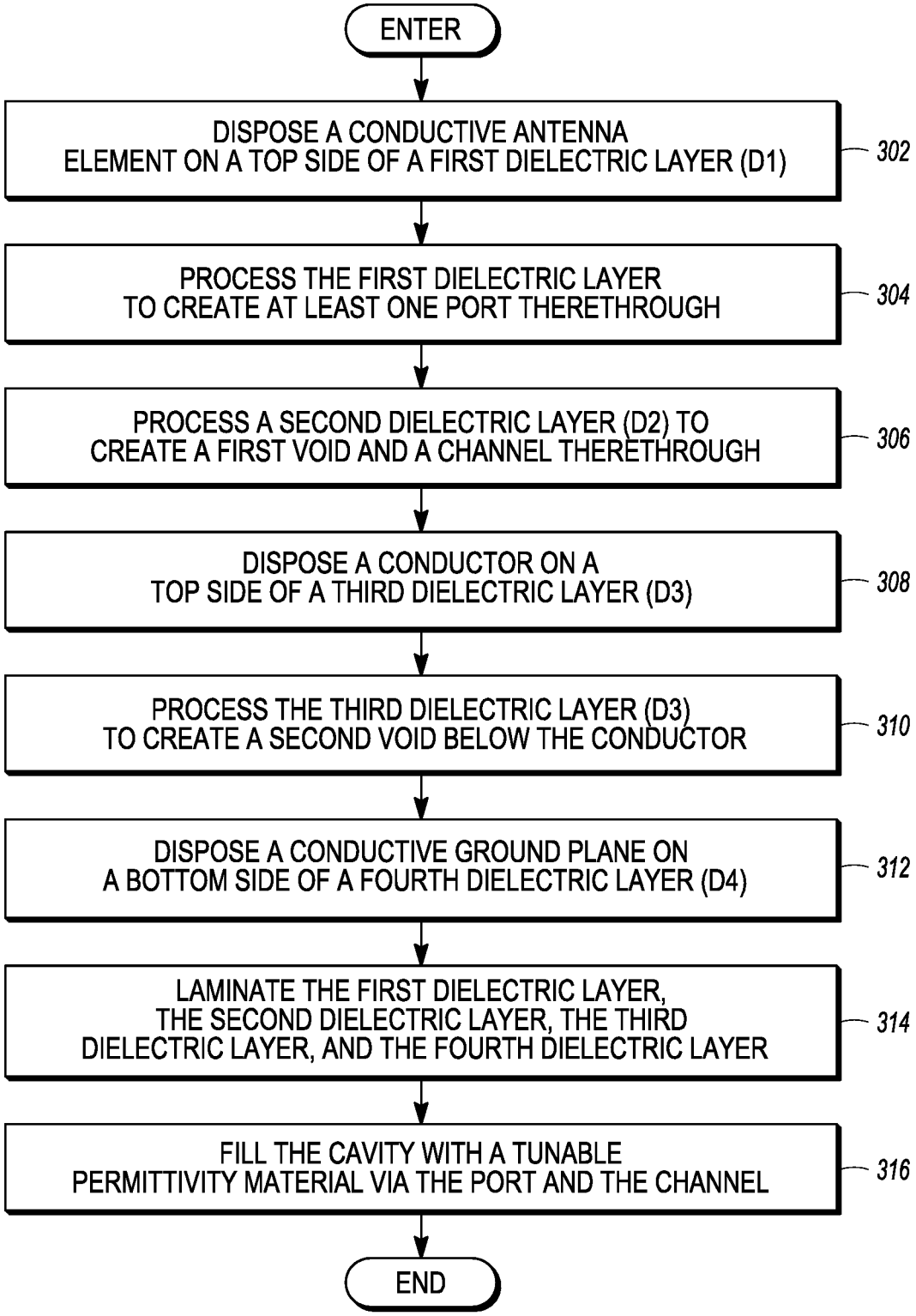
FIG. 3 is a diagram illustrating exemplary operations that can be used to produce the electronically steerable conformal antenna.
Figure 4:
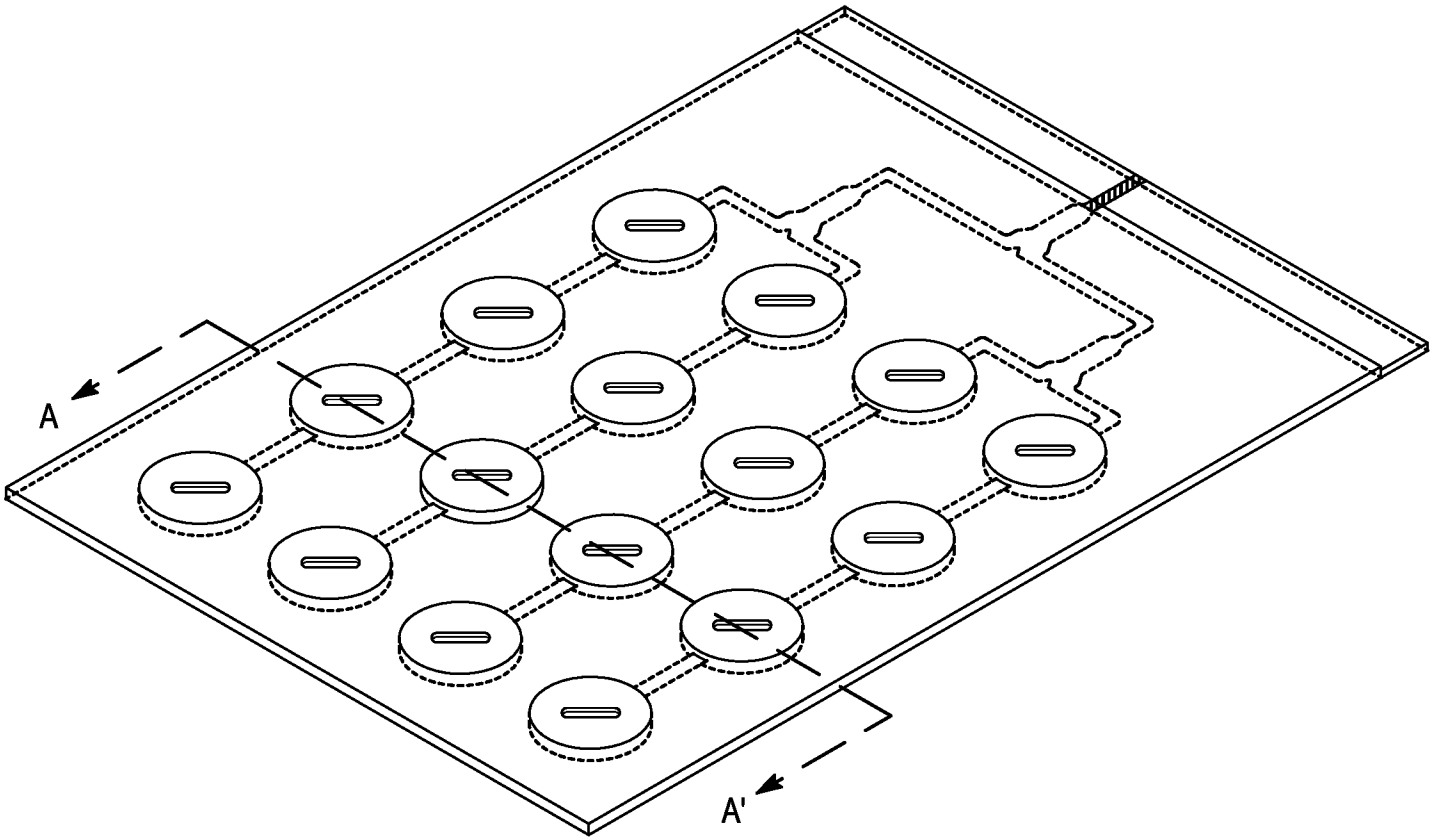
FIG. 4 is a diagram illustrating the slice A-A' of the antenna 100 depicted in FIGS. 5A-5C.
Figure 5A:
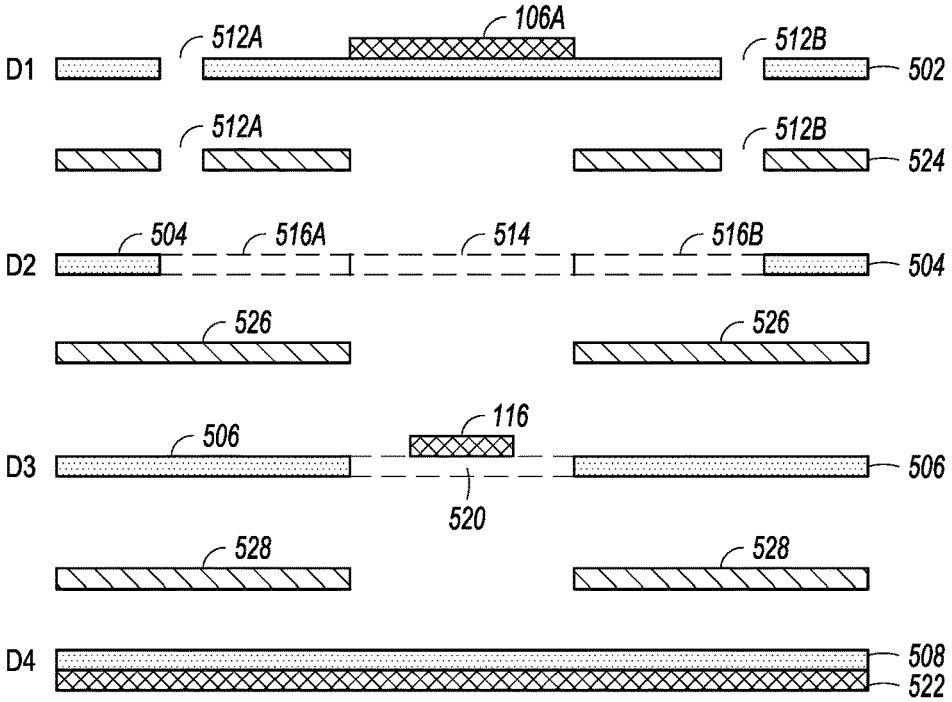
FIGS. 5A-5C are diagrams depicting the electronically steerable conformal antenna at different stages of a representative production process at slice A-A' of FIG. 4.
Figure 5B:
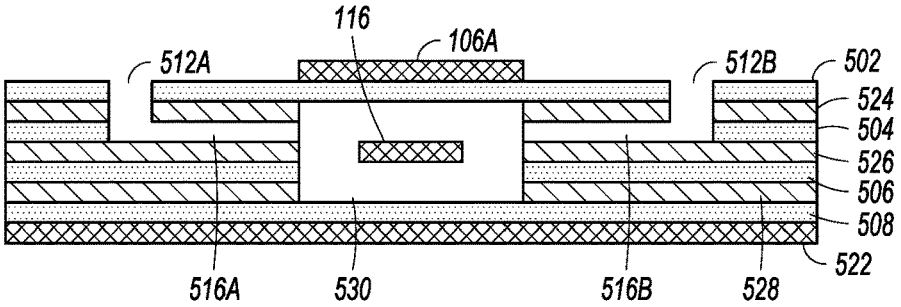
Figure 5C:
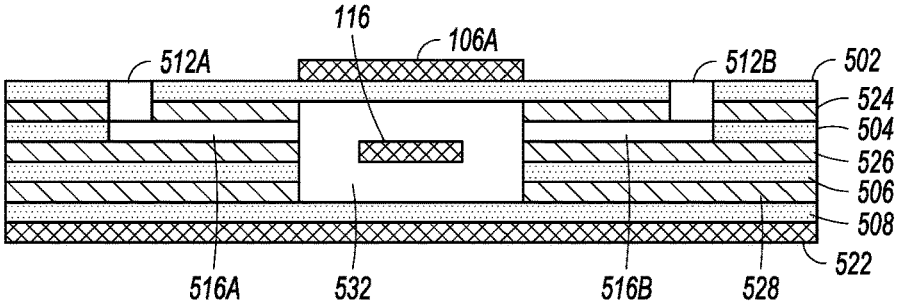
Figure 6:
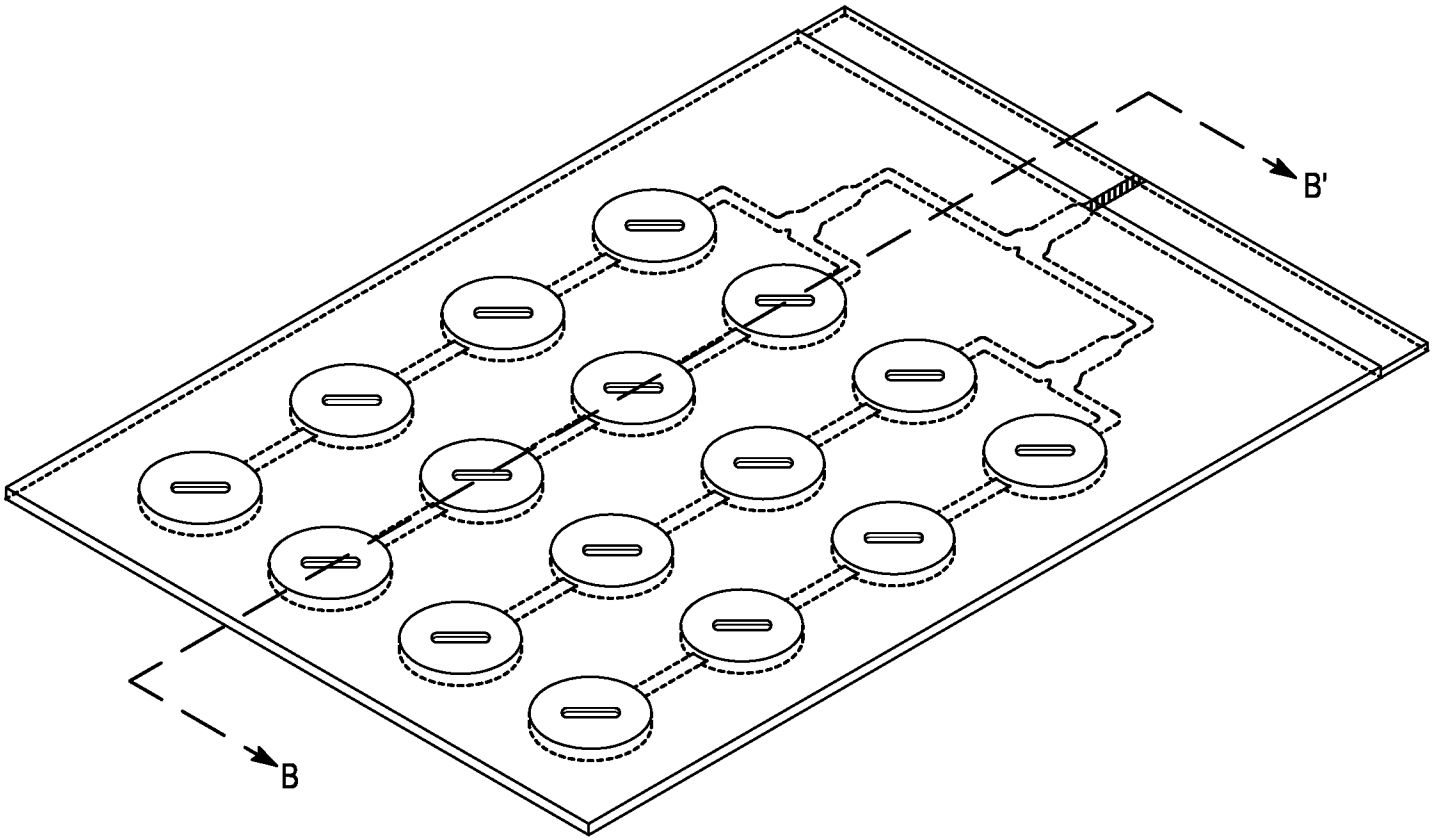
FIG. 6 is a diagram illustrating the slice B-B' of the antenna depicted in FIGS. 7A-7C.

FIG. 3 is a diagram illustrating exemplary operations that can be used to produce the electronically steerable conformal antenna 100. FIG. 3 will be discussed in conjunction with FIGS. 4, 5A-5C, 6, and 7A-7C, which are diagrams depicting the electronically steerable conformal antenna at different stages of a representative production process. FIG. 4 is a diagram illustrating the cut A-A' of the antenna 100 depicted in FIGS. 5A-5C, while FIG. 6 is a diagram illustrating the cut B-B' of the antenna 100 depicted in FIGS. 7A-7C.

Turning now to FIG. 3, in block 302, a conductive antenna element component 106A is disposed on a top surface of a first dielectric layer 502 (also labeled D1). In block 304, the first dielectric layer 502 is processed to create at least one port 512A therethrough. In the embodiment illustrated in FIG. 5A, the first dielectric layer 502 is also processed to create a second port 512B. The second port 512B is located at a place diametrically opposed to the first port 512A and offset from the conductive antenna element 106A by a second horizontal distance approximating that of the horizontal distance from the conductive antenna element 106A to the first port 512A.

In block 306, a second dielectric layer 504 (also labeled D2) is processed to create a first void 514 and a channel 516A. In the illustrated embodiment in FIG. 5A, a second channel 516B is also created for access to the second port 512B. The second port 512B and second channel 516B assist in the fluidic insertion of dielectric material into the antenna 100 structure.

In block 308, a conductor 116 is disposed on the top surface of a third dielectric layer 506 (also labeled D3). In block 310, the third dielectric layer 506 is processed to create a second void 520 below the first void 514 and the conductor 116 with the conductor 116 disposed between the first void 514 and the second void 520. In block 312, a conductive ground plane 522 is formed on a bottom surface of a fourth dielectric layer 508 (also labeled D4).

In block 314, the first dielectric layer 502, the second dielectric layer 504, the third dielectric layer 506, and the fourth dielectric layer 508 are aligned and laminated together. Upon lamination of the dielectric layers 502, 504, 506 and 508, the first void 514 is disposed between the conductive antenna element component 106A and the conductive ground plane 522, and the first void 514 and the second void 520 together form a cavity 530 disposed between the conductive antenna element component 106A and the conductive ground plane 522, and the conductor 116 is disposed through the cavity 530, between the first void 514 and the second void 520 as illustrated in FIG. 5B. Also, upon lamination of the dielectric layers 502, 504, 506 and 508, and the port 512A and channel 516A are in fluid communication (e.g. they are coupled to allow free passage of fluids including air) within the cavity 530. This fluid communication is used to fill the cavity with a tunable permittivity material via the port 512A and the channel 516A, as shown in block 316 and illustrated in FIG. 5C. After such filling, the ports 512A and 512B may be sealed with an epoxy.

Figure 7A:
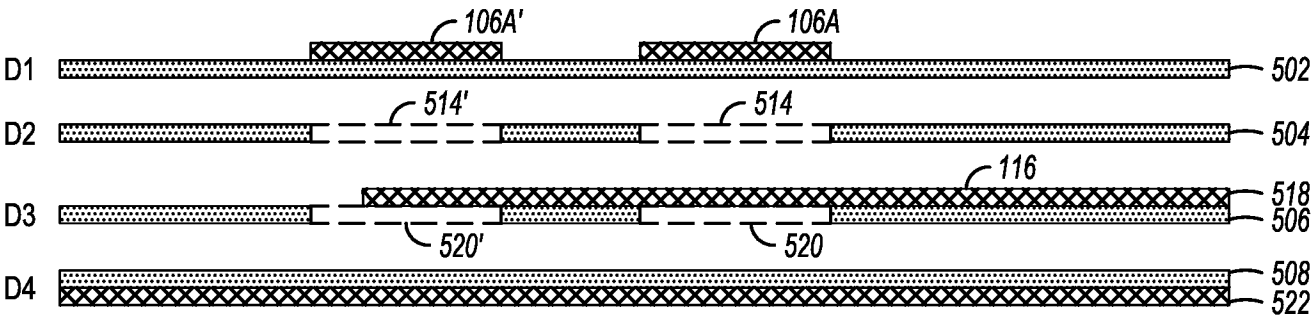
FIGS. 7A-7C are diagrams depicting the electronically steerable conformal antenna at the different stages of the production at the slice B-B' illustrated in FIG. 6.
Figure 7B:
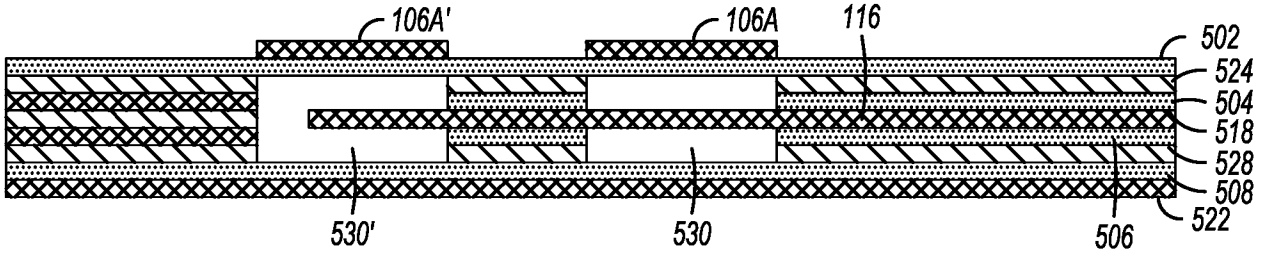
Figure 7C:
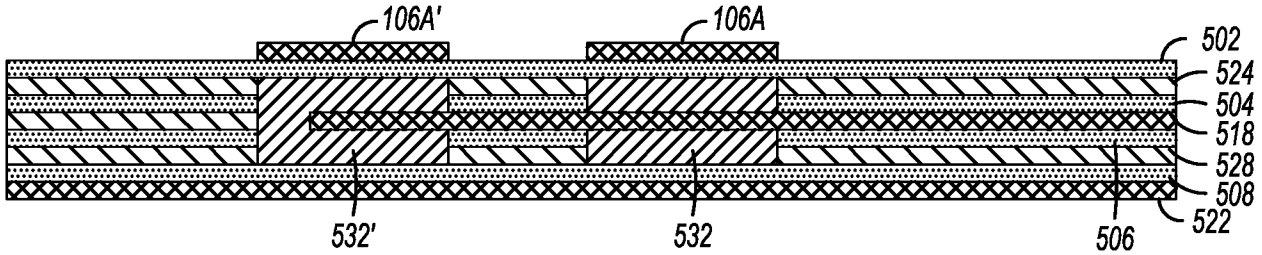

The foregoing steps illustrate the creation of one antenna element 106 on the RF circuit board 101. Typically, the antenna 100 comprises an array of elements such as the 4×4 array of elements illustrated in FIG. 1A. In such case, the operations disclosed above include analogous operations as applied to any other desired antenna elements in the array. For example, FIGS. 7A-7C illustrate the electronically steerable conformal antenna 100 at different stages of production along the cut B-B' depicted in FIG. 6. Note that a second conductive antenna element component 106A' is disposed on the top surface of the first dielectric layer, and the second dielectric layer 504 is also processed to create another void 514.' Although not illustrated, a second port and channel are also created using analogous techniques. FIGS. 7A-7C also illustrate disposing the conductor 116 such that the conductor 116 extends through the cavity 530 and at least partially through the adjacent cavity 530'.

In one embodiment, the aforementioned processing to create the ports, voids, and channels is accomplished by a subtractive technique such as laser etching, milling, or wet etching. Furthermore, the disposition of conductive material on the dielectric may be accomplished by additive methods such as dispense printing or film deposition of suitable conductive materials (e.g., silver, copper, etc.) to the appropriate surface of the dielectric. The lamination of the first dielectric layer 502, the second dielectric layer 504, the third dielectric layer 506, and the fourth dielectric layer 508 can be accomplished by disposing a first adhesive film 524 between the first dielectric layer 502 and the second dielectric layer 504, disposing a second adhesive film 526 between the second dielectric layer 504 and the third dielectric layer 506, and disposing a third adhesive film 528 between the third dielectric layer 506 and the fourth dielectric layer 508. Portions of the adhesive films 524, 526, and 528 that must be removed to achieve the structure shown in FIGS. 5A-5C may be removed before lamination, or processed after lamination (e.g., using an etching technique). Further, layers 502, 504, 506 and 508 may be created in any order, but unless otherwise noted, should be layered as illustrated before lamination. Nominally, dielectric layers 502, 504, 506 and 508 are composed of a dielectric material having a relative permittivity (ratio of absolute permittivity to the permittivity of a vacuum) of approximately ten.

Figure 8A:
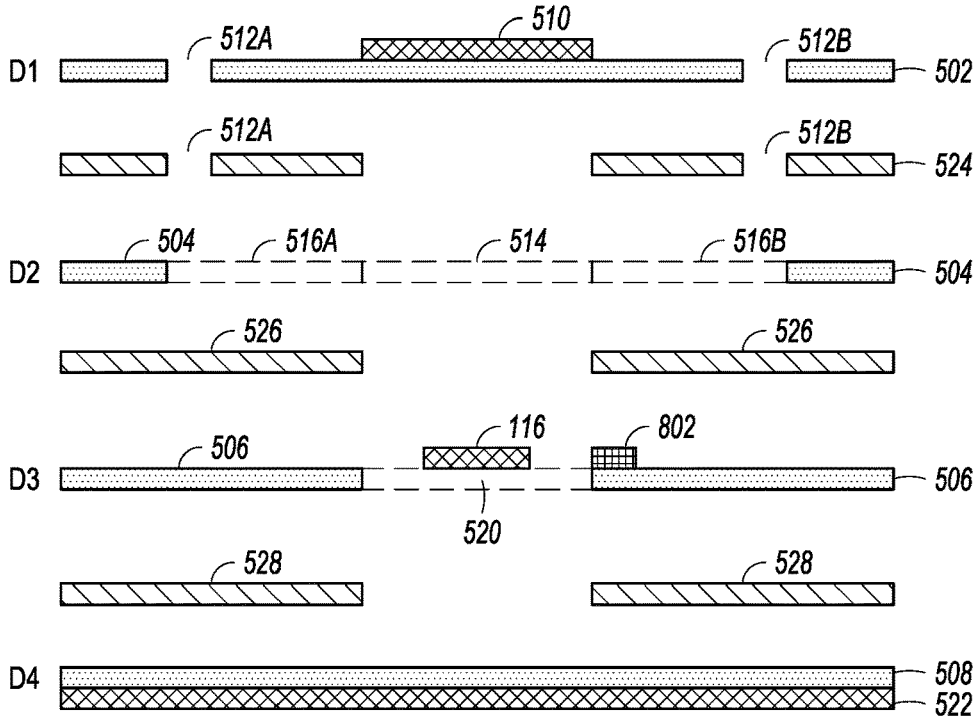
FIGS. 8A-8C are diagrams illustrating how a DC bias voltage may be supplied to the tunable permittivity material via the RF circuit board.
Figure 8B:
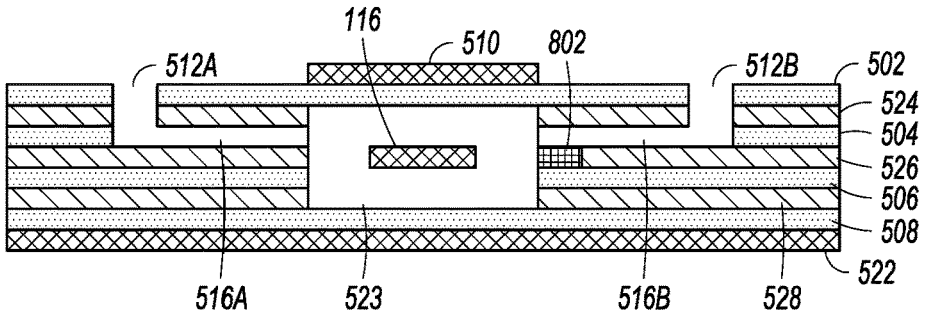
Figure 8C:
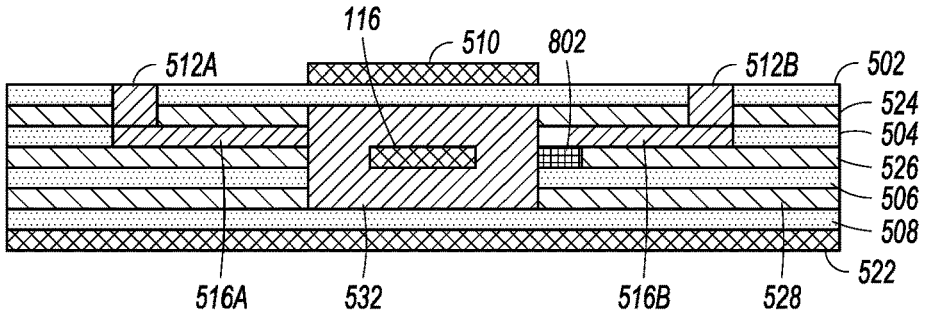

FIGS. 8A-8C are diagrams illustrating how a DC bias voltage may be supplied to the tunable permittivity material 532 via the RF circuit board 101. A conductor 802 for carrying the DC bias voltage can be added to the top surface of the third dielectric layer 506 as illustrated in location allowing contact with the tunable permittivity material 532. This conductor 802 may be then routed in the RF circuit board 101 to a source of the DC bias voltage. If the antenna 100 is to permit beam steering in only one axis, the same conductor 802 may be routed to all of the antenna elements 106 in a row (or column) of antenna elements 106, with a different conductor routed to all of the antenna elements 106 of a different row (or column) of antenna elements 106. If the antenna 100 is to permit beam steering in two axes (e.g. about both the X and Y axes), the tunable permittivity material 532 of each conductor 802 needs to be separately controlled, requiring a dedicated trace in the RF circuit board 101 to the conductor 802 associated with each tunable permittivity material 532. Further, while the conductor 802 is illustrated as being disposed adjacent to the cavity 530 and on the third dielectric layer 506, other embodiments that allow the DC bias voltage to be applied to the tunable permittivity material 532 can also be used. For example, the conductor 802 may be disposed on a top (or bottom) surface of the first dielectric layer 502, on a top (or bottom) surface of the second dielectric layer 504 (but not interfering with the channel 516), on a bottom surface of the third dielectric layer 506, or on a top surface of the fourth dielectric layer 508.

Signal Transception

The foregoing antenna 100 can be used to transmit and/or receive (transceive) signals. In transmission, signals provided to the feed created by conductor 116 are transformed into a transmitted RF signal by antenna elements 106 and associated structures. In reception, RF signals are provided to the antenna elements 106 and associated structures and transformed into a received signal at the conductor 116.

For example, referring again to FIG. 1A, when used for transmission, the antenna 100 receives a signal at power input, and this signal is provided by the conductor 116 to the aperture coupled antenna elements 106 for transmission as an RF signal. The permittivity of the dielectric material disposed in a tunable cavity 120 between the plurality of antenna elements 106 and the ground plane is selectively controlled by application of a DC bias voltage, thus controlling the resonant frequency of the plurality of antenna elements 106.

Hardware Environment

Figure 9:
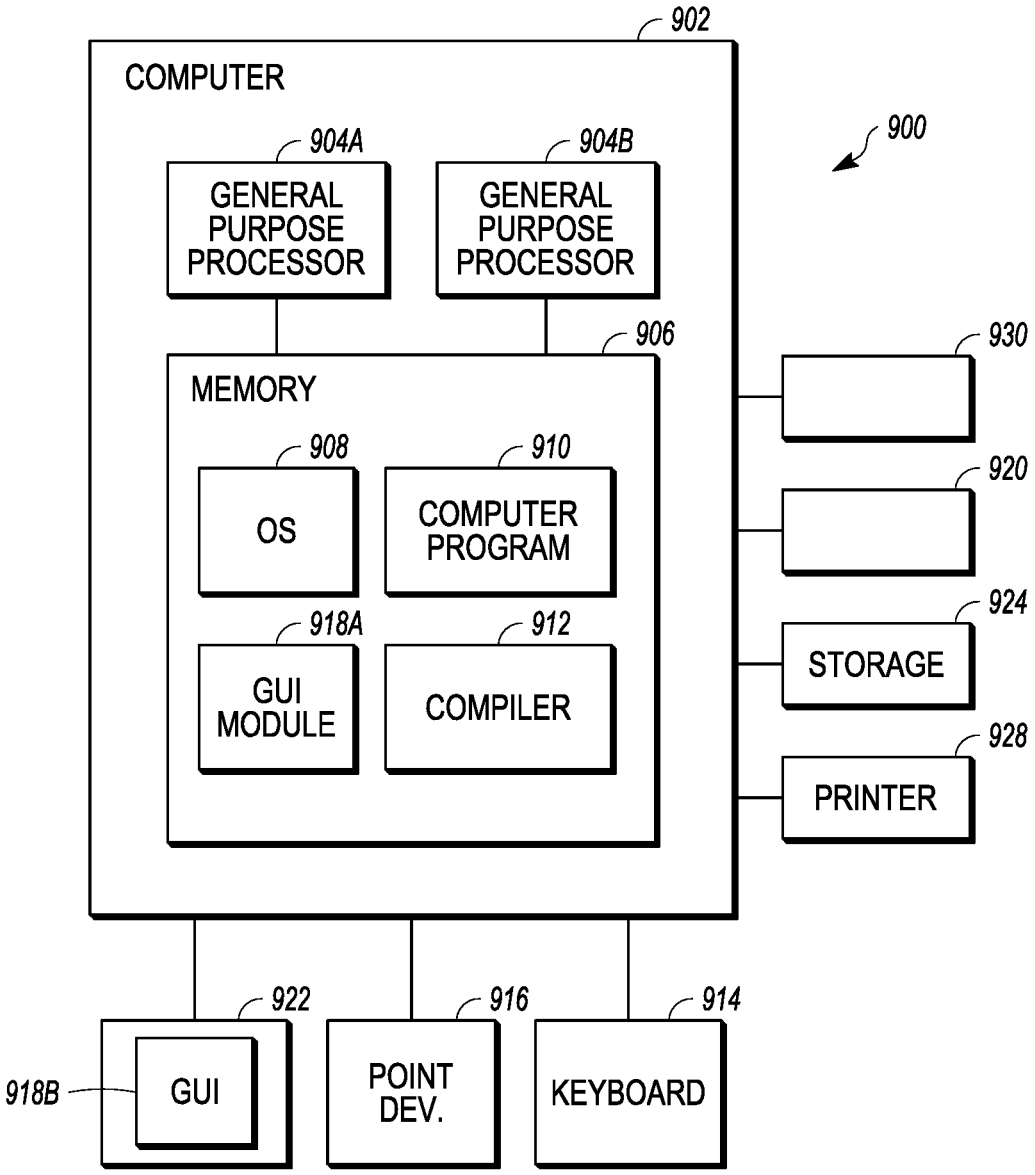
FIG. 9 is a diagram illustrating an exemplary computer system that could be used to implement processing elements of the above disclosure.

FIG. 9 is a diagram illustrating an exemplary computer system 900 that could be used to implement processing elements of the above disclosure, including the defining of the conductive structures and etching of the dielectric layers. The computer 902 comprises a general purpose processor 904A and/or a general purpose processor 904B and a memory, such as random access memory (RAM) 906. The computer 902 is operatively coupled to a display 922, which presents images such as windows to the user on a graphical user interface 918B. The computer 902 may be coupled to other devices, such as a keyboard 914, a mouse device 916, a printer, etc. Of course, those skilled in the art will recognize that any combination of the above components, or any number of different components, peripherals, and other devices, may be used with the computer 902, including printer 928.

Generally, the computer 902 operates under control of an operating system 908 stored in the memory 906, and interfaces with the user to accept inputs and commands and to present results through a graphical user interface (GUI) module 918A. Although the GUI module 918B is depicted as a separate module, the instructions performing the GUI functions can be resident or distributed in the operating system 908, the computer program 910, or implemented with special purpose memory and processors. The computer 902 also implements a compiler 912 which allows an application program 910 written in a programming language such as COBOL, C++, FORTRAN, or other language to be translated into processor 904 readable code. After completion, the application 910 accesses and manipulates data stored in the memory 906 of the computer 902 using the relationships and logic that was generated using the compiler 912. The computer 902 also optionally comprises an external communication device such as a modem, satellite link, Ethernet card, or other device for communicating with other computers.

In one embodiment, instructions implementing the operating system 908, the computer program 910, and the compiler 912 are tangibly embodied in a computer-readable medium, e.g., data storage device 920, which could include one or more fixed or removable data storage devices, such as a zip drive, floppy disc drive 924, hard drive, CD-ROM drive, tape drive, etc. Further, the operating system 908 and the computer program 910 are comprised of instructions which, when read and executed by the computer 902, causes the computer 902 to perform the operations herein described. Computer program 910 and/or operating instructions may also be tangibly embodied in memory 906 and/or data communications devices 930, thereby making a computer program product or article of manufacture. As such, the terms "article of manufacture," "program storage device" and "computer program product" as used herein are intended to encompass a computer program accessible from any computer readable device or media.

Those skilled in the art will recognize many modifications may be made to this configuration without departing from the scope of the present disclosure. For example, those skilled in the art will recognize that any combination of the above components, or any number of different components, peripherals, and other devices, may be used.

CONCLUSION

This concludes the description of the preferred embodiments of the present disclosure.

The foregoing description of the preferred embodiment has been presented for the purposes of illustration and description. It is not intended to be exhaustive or to limit the disclosure to the precise form disclosed. Many modifications and variations are possible in light of the above teaching. It is intended that the scope of rights be limited not by this detailed description, but rather by the claims appended hereto.

What is claimed is:

1. An electronically steerable conformal antenna, comprising:

a circuit board, comprising:

a composite dielectric, having:

a bottom surface, having:

a conductive ground plane;

a top surface, having:

an array of a plurality of antenna elements disposed on the top surface;

an array of tunable cavities, each tunable cavity disposed between an associated antenna element of the plurality of antenna elements and the bottom surface conductive ground plane; and a conductor, extending from an antenna input through the composite dielectric and the tunable cavities, the conductor forming a microstrip between each of the antenna elements.

2. The electronically steerable conformal antenna of claim 1, wherein:

each tunable cavity comprises a tunable permittivity material.

3. The electronically steerable conformal antenna of claim 2, wherein the tunable permittivity material comprises a liquid crystal.

4. The electronically steerable conformal antenna of claim 2, wherein each tunable cavity is individually tuned by application of a DC bias voltage.

5. The electronically steerable conformal antenna of claim 1, wherein:

each of the plurality of antenna elements comprises a conductive surface having a slot; and at least a portion of the conductor is disposed within each of the cavities between the slot and the bottom surface conductive ground plane.

6. The electronically steerable conformal antenna of claim 5, wherein the conductor further forms one or more power dividers between the antenna input and portions of conductors disposed within each of the cavities between the slot and the bottom surface conductive ground plane.

7. The electronically steerable conformal antenna of claim 1, wherein:

the antenna elements are formed by a first conductive material on a top surface of a first layer of the composite dielectric;

the conductor is formed by a second conductive material on a top surface of a third layer of the composite dielectric; and the bottom surface conductive ground plane is formed by a third conductive material on a bottom surface of a fourth layer of the composite dielectric.

8. The electronically steerable conformal antenna of claim 7, wherein:

the first conductive material is patterned on the top surface of the first layer of the composite dielectric;

the second conductive material is patterned on the top surface of the third layer of the composite dielectric; and the third conductive material is patterned on the bottom surface of the fourth layer of the composite dielectric.

9. The electronically steerable conformal antenna of claim 7, wherein:

the first conductive material is printed on the top surface of the first layer of the composite dielectric;

the second conductive material is printed on the top surface of the third layer of the composite dielectric; and the third conductive material is printed on the bottom surface of the fourth layer of the composite dielectric.

10. A method of forming a steerable conformal antenna, comprising:

disposing a conductive antenna element on a top surface of a first dielectric layer;

processing the first dielectric layer to create at least one port therethrough;

processing a second dielectric layer to create a first void and a channel therethrough;

disposing a conductor on a top surface of a third dielectric layer;

processing the third dielectric layer to create a second void below the conductor;

disposing a conductive ground plane on a bottom surface of a fourth dielectric layer;

laminating the first dielectric layer, the second dielectric layer, the third dielectric layer, and the fourth dielectric layer, wherein upon lamination:

the first void is disposed between the conductive antenna element and the conductive ground plane; and the first void and the second void together form a cavity disposed between the conductive antenna element and the conductive ground plane having the conductor disposed therethrough and the port and channel are in fluid communication with the cavity; and filling the cavity with a tunable permittivity material via the port and the channel.

11. The method of claim 10, wherein the cavity comprises a liquid crystal.

12. The method of claim 10, wherein the first dielectric layer, the second dielectric layer, the third dielectric layer, and the fourth dielectric layer are laminated via adhesive films disposed between each dielectric layer.

13. The method of claim 10, wherein:

disposing the conductive antenna element on a top surface of a first dielectric layer comprises patterning a conductive material on the top surface of the first dielectric layer; and disposing the conductor on the top surface of the third dielectric layer comprises patterning the conductor on the top surface of the third dielectric layer.

14. The method of claim 10, wherein:

disposing the conductive antenna element on a top surface of a first dielectric layer comprises printing a conductive material on the top surface of the first dielectric layer; and disposing the conductor on the top surface of the third dielectric layer comprises printing the conductor on the top surface of the third dielectric layer.

15. The method of claim 10, wherein processing the first dielectric layer to create at least one port therethrough comprises:

etching the first dielectric layer to create a first port offset a horizontal distance from the conductive antenna element; and etching the first dielectric layer to create a second port offset the horizontal distance from the conductive antenna element and diametrically opposed from the first port about the conductive antenna element.

16. A steerable conformal antenna, formed by performing steps comprising the steps of:

disposing a conductive antenna element on a top surface of a first dielectric layer;

processing the first dielectric layer to create at least one port therethrough;

processing a second dielectric layer to create a first void and a channel therethrough;

disposing a conductor on a top surface of a third dielectric layer;

processing the third dielectric layer to create a second void below the conductor;

disposing a conductive ground plane on a bottom surface of a fourth dielectric layer;

laminating the first dielectric layer, the second dielectric layer, the third dielectric layer, and the fourth dielectric layer, wherein upon lamination:

the first void is disposed between the conductive antenna element and the conductive ground plane; and the first void and the second void form a cavity disposed between the conductive antenna element and the conductive ground plane having the conductor disposed therethrough and the channel fluidly coupled to the cavity; and filling the cavity with a tunable permittivity material via the port and the channel.

17. The steerable conformal antenna of claim 16, wherein the cavity comprises a liquid crystal.

18. The steerable conformal antenna of claim 16, wherein:

disposing the conductive antenna element on a top surface of a first dielectric layer comprises patterning a conductive material on the top surface of the first dielectric layer; and disposing the conductor on the top surface of the third dielectric layer comprises patterning the conductor on the top surface of the third dielectric layer.

19. The steerable conformal antenna of claim 16, wherein:

disposing the conductive antenna element on a top surface of a first dielectric layer comprises printing a conductive material on the top surface of the first dielectric layer; and disposing the conductor on the top surface of the third dielectric layer comprises printing the conductor on the top surface of the third dielectric layer.

20. The steerable conformal antenna of claim 16, wherein processing the first dielectric layer to create at least one port therethrough comprises:

etching the first dielectric layer to create a first port offset a horizontal distance from the conductive antenna element; and etching the first dielectric layer to create a second port offset a second horizontal distance and diametrically opposed from the first port about the conductive antenna element.

21. A method of transmitting a signal, comprising:

receiving the signal at an input of an antenna having a plurality of aperture coupled antenna elements;

controlling a resonant frequency of the plurality of antenna elements by controlling a permittivity of a dielectric material disposed between the plurality of antenna elements and a ground plane of the antenna; and transmitting the signal using the plurality of aperture coupled antenna elements.

22. The method of claim 21, wherein the permittivity of a dielectric material is altered by application of a DC bias voltage.

* * * * *